United States Patent [19]

Stridh

[11] Patent Number: 4,790,116

[45] Date of Patent: Dec. 13, 1988

[54] APPARATUS FOR AUTOMATICALLY PACKING PRODUCTS IN PACKAGES

[76] Inventor: Kent Stridh, Falsterbovägen 50, S-236 00 Höllviksnäs, Sweden

[21] Appl. No.: 31,069

[22] PCT Filed: Jun. 18, 1986

[86] PCT No.: PCT/SE86/00295

§ 371 Date: Jun. 20, 1985

§ 102(e) Date: Jun. 20, 1985

[87] PCT Pub. No.: WO86/07573

PCT Pub. Date: Dec. 31, 1986

[30] Foreign Application Priority Data

Jun. 20, 1985 [SE] Sweden ..... 8503072

[51] Int. Cl.[4] ..... B65B 35/30

[52] U.S. Cl. ..... 53/244; 53/251; 53/377; 53/543

[58] Field of Search ..... 53/244, 245, 249, 251, 53/252, 376, 377, 543, 536, 535

[56] References Cited

U.S. PATENT DOCUMENTS

| | | | |
|---|---|---|---|
| 2,324,930 | 7/1943 | Joa . | |
| 2,728,508 | 12/1955 | Marasso . | |
| 3,119,213 | 1/1964 | Kinney | 53/245 X |
| 3,279,927 | 10/1966 | Reid | 53/252 X |
| 3,300,945 | 1/1967 | Grossi et al. | 53/251 X |
| 3,557,528 | 1/1971 | Voorhis | 53/377 |
| 4,344,523 | 8/1982 | May et al. | 53/251 X |
| 4,578,930 | 4/1986 | Simelunas et al. | 53/251 X |

FOREIGN PATENT DOCUMENTS

| | | | |
|---|---|---|---|
| 1281925 | 10/1968 | Fed. Rep. of Germany | 53/376 |
| 2445868 | 4/1976 | Fed. Rep. of Germany | 53/543 |
| 3130103 | 10/1982 | Fed. Rep. of Germany . | |
| 21026836 | 9/1970 | France . | |
| 2026836 | 9/1970 | France . | |
| 2259750 | 8/1975 | France | 53/543 |
| 99155 | 1/1960 | Norway . | |
| 384990 | 5/1976 | Sweden . | |
| 384990 | 5/1976 | Sweden . | |
| 8401762 | 5/1984 | World Int. Prop. O. . | |

*Primary Examiner*—James F. Coan
*Assistant Examiner*—Steven P. Weihrouch
*Attorney, Agent, or Firm*—Beveridge, DeGrandi & Weilacher

[57] ABSTRACT

An apparatus for automatically packaging products in packages includes a collecting station, a delivery station, a packing station having a shaft-chain device with carrier members and a conveyor which travels through the delivery station and the packing station. The carrier members collect products at the collecting station and carrying the products across the conveyor. The packing station also includes fingers located in the path of movement of the carrier members to contact a first row of products and cause the products to drop into packages which are conveyed by the conveyor. Preferably a sealing station including a sealing plate fixed to a rotatably mounted ring is also provided. When the ring is rotated, the sealing plate rotates in a circular, sector-shaped path to fold over the cover of a package to seal the cover to a bottom portion of the package. The end of the conveyor conveying the filled and sealed packages downstream of the sealing station provides a discharge station from which the packages can be removed for further handling.

11 Claims, 5 Drawing Sheets

APPARATUS FOR AUTOMATICALLY PACKING PRODUCTS IN PACKAGES

BACKGROUND OF THE INVENTION

The present invention relates to an apparatus for automatically packing products in a package, comprising a delivery station for empty packages, a collecting station with products, a packing station located opposite the collecting station and arranged for packing the products in the package, and a conveyor which travels through the delivery station and the packing station and on which the package is placed, the packing station having carrier members which can be moved substantially transversely of the conveyor for collecting products from the collecting station opposite the packing station, with the products resting on the carrier members.

In series manufacture of products, it is often desirable to attain a maximum degree of automation. Optimally, both manufacture and packing are performed automatically with a minimum number of attending personnel. Generally speaking, the development has advanced furthest in the automation of the manufacturing process, while the packing operation, surprisingly often, is still performed manually. This also applies to the food and baking industry, often involving products that must be handled with great care, such as biscuits, cream puffs etc. Because of the fragility of these products, it is necessary in most cases to resort to manual packing, which is of course a slow operation requiring a certain number of personnel. Moreover, manual packing does not comply with high hygienic standards.

Many attempts have been made to automate the packing of biscuits and the like. One example is disclosed in DK published application 126,635 describing a method and an apparatus for transferring biscuits from a conveyor belt into paper moulds, which is effected by means of a transfer mechanism having a number of suction nozzles which are movable back and forth between a collecting station and a delivery station. An obvious drawback of this apparatus is that fragile products, such as cream puffs, can be damaged by the suction nozzles. Further, the products must have a suitable form to be properly sucked by the suction nozzles.

SUMMARY OF THE INVENTION

The object of the present invention is to provide an apparatus ensuring rapid and automatic packing of products in packages, without causing any damage to the products, e.g. cream puffs or biscuits.

This object and further objects stated in the following description are achieved by means of the apparatus stated by way of introduction, which is characterized in that means provided in the path of movement of the carrier members across the conveyor are adapted to remove the products from the carrier members so that the products will drop into the package.

According to a preferred embodiment of the invention, the conveyor travelling through the apparatus consists of a chain having drivers for moving the packages through the apparatus and for orienting them when the products should be placed in the packages and, as the case may be, when the packages should be sealed.

Where it is desirable to pack the products in packages comprising a trough-shaped bottom part and a folding cover connected thereto, the apparatus preferably comprises a sealing station having a sealing means which is adapted to engage with the cover of the filled package and which can be moved over the package for sealing the cover to the bottom part.

Further features of the invention are stated in the accompanying claims.

The apparatus according to the invention ensures a very high product-packing capacity. In a practical test, cream puffs were packed in troughs, each of which held 15 puffs and which were delivered to the packing station two by two. In this test, 20,000 puffs/h were packed and the apparatus was attended by one operator. In order to pack the same amount of puffs manually, 3–4 operators were required.

As previously mentioned, the products are supplied at a collecting station which is located opposite the packing station in which the products are brought together with the packages. The collecting station preferably consists of a conveyor device including conveyor belts on which the planar surfaces of the products are resting. PCT application publication No. WO84/01762 describes a machine in which the collecting station comprises several narrow, parallel, spaced-apart conveyor belts between which carrier members can be moved for collecting products. A collecting station of the same basic design is advantageously used in the apparatus according to the invention. The products, e.g. cream puffs, are queuing on these conveyor belts before being collecting and placed in the packages.

BRIEF DESCRIPTION OF THE DRAWINGS

The invention and its many advantages will be described in more detail hereinbelow with reference to the accompanying drawings.

DETAILED DESCRIPTION OF THE PREFERRED EMBODIMENTS

Figure 1:
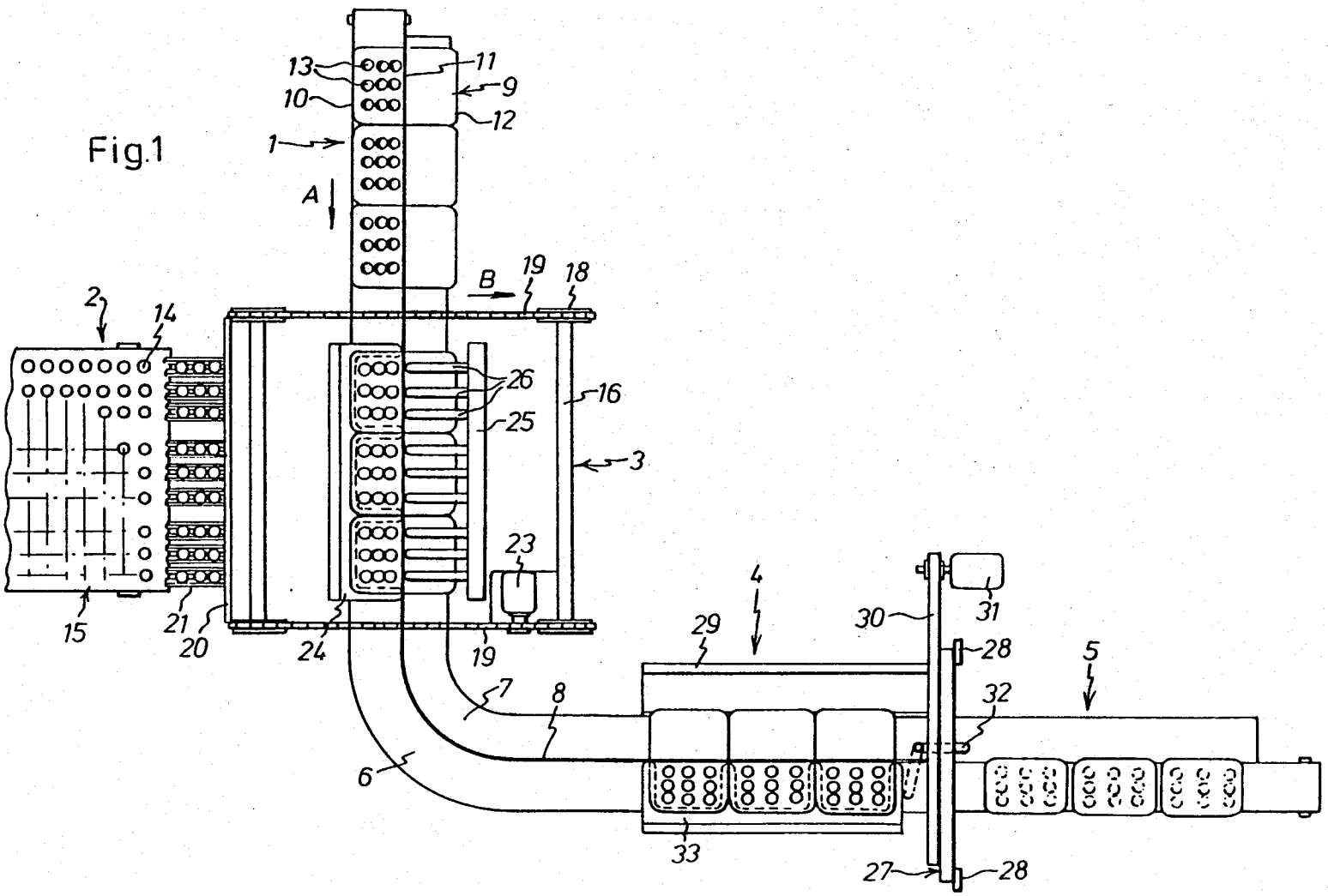
FIG. 1 shows an apparatus according to the invention from above.

In FIG. 1, there is shown an apparatus according to the invention, comprising a delivery station 1, a collecting station 2, a packing station 3, a sealing station 4, and a discharge station 5. A conveyor 6, preferably a conveyor belt, travels in the direction of arrow A through the delivery station 1, the packing station 3, the sealing station 4 and the discharge station 5. Adjacent and parallel to the conveyor 6 extends a table 7 whose edge portion facing the conveyor 6 has an upright guide rail 8. Empty packages 9 comprising a bottom part 10 and a folding cover 12 connected to the bottom part along a line of articulation 11, are intended to be placed on the conveyor 6 and the table 7 in the delivery station 1, thus including one end portion of the conveyor 6. The upright guide rail 8 serves as a guide for the packages 9 which are of the blister type. The products 14 are cream puffs, biscuits or the like and preferably have a substantially planar bottom surface.

The collecting station 2 comprises a schematically shown conveyor device 15 on which the products 14 are queued in rows prior to packing. The conveyor device 15 preferably is of the known, previously mentioned type having several narrow, parallel conveyor belts.

Figure 2:
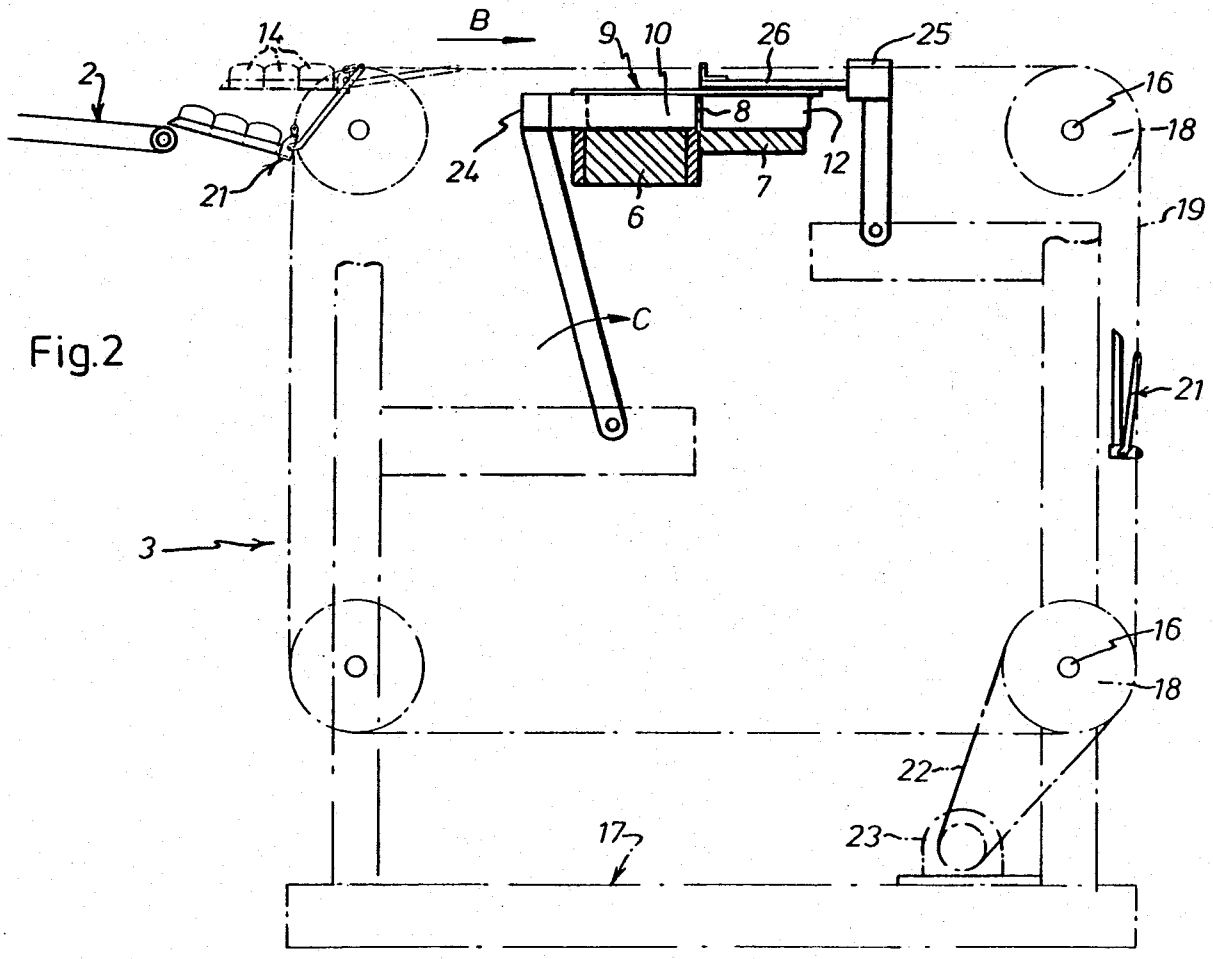
FIG. 2 shows the collecting station and the packing station of the apparatus from the side with certain parts in section.

The packing station 3 comprises four shafts 16 which are mounted in a frame 17, as schematically shown in FIG. 2. The shafts 16 are parallel to the conveyor 6 and are provided at their ends with sprockets 18 over which endless chains 19 pass. A first holder 20 is provided parallel to the shafts 16 and fixed at its respective ends to the chains 19. Carrier members 21 for the products 14 are mounted on the holder 20. The chains 19 can be driven in the direction of arrow B in that one sprocket 18 of the shafts 16 is connected via a chain 22 to a first motor 23 (see FIG. 2). When the shaft-chain device 16, 18, 19 is driven, the holder 20 with the carrier members 21 is moved in the direction of arrow B across the conveyor 6.

In this embodiment, the packing station 3 also comprises a first centering arm 24 which is mounted in the frame 17 and can be pivoted in over the conveyor 6 in such a manner that, by its recesses, it will hold and centre the packages 9 on the conveyor 6. The centering arm 24 is preferably exchangeable to suit different packages 9. Further, the packing station 3 has a second holder 25 which is mounted in the frame 17 and from which fingers 23 project over the conveyor 6 and the table 7. The fingers 26 are disposed opposite the carrier members 21 and in the path of movement thereof. The holder 25 is partly movable in over the conveyor 6. The packing of the products 14 will be described below.

After the products have been packed, the filled packages 9 are conveyed to the sealing station 4 comprising a ring 27 which is rotatably mounted in a frame comprising two uprights 28. A sealing plate 29 is fixed at one end to the ring 27 and projects therefrom in a direction contrary to the direction of travel A of the conveyor 6. The ring 27 is rotatable by means of an endless belt 30 driven by a second motor 31. The edge portion of the sealing plate 29 facing the conveyor 6 can engage with the covers 12 of the packages 9. When the ring 27 is rotated, the sealing plate 29 is moved in a circular sector-shaped path, and the cover 12 is folded over the bottom part 10 (see FIG. 3). The sealing station 4 also comprises a stop 32 which is mounted on the table 7 and can be swung in over the conveyor 6 in order to stop the packages 9 before the sealing operation is carried out. Further, this embodiment comprises a second centering arm 33 which is mounted in the frame of the sealing station 4 at one of the uprights 28. The centering arm 33 can be pivoted in over the conveyor 6 and, by means of recesses therein, holds and centers the packages 9 before sealing is effected. Like the centering arm 24 previously described, the centering arm 33 is exchangeable.

Finally, the apparatus has a discharge station 5 including the other end portion of the conveyor 6, from which the filled and sealed packages 9 are removed for further handling. The discharge station 5 may optionally be connected to a device for automatically packing the finished packages 9.

FIG. 2 illustrates the interaction between the collecting station 2 and the packing station 3. As previously mentioned, the products 14 are queued in the collecting station 2 and are collected therefrom by means of the carrier members 21 which, in the upper left-hand portion of FIG. 2, are shown in two different positions where the chain 19 is passing over the sprocket 18. When empty packages 9 are moved into the packing station 3, the first centering arm 24 is pivoted in over the conveyor 6 in the direction of arrow C and momentarily holds the packages 9. The shaft-chain device 16, 18, 19 is thereafter driven by the first motor 23, and the carrier members 21 are moved in the direction of arrow B across the conveyor 6 in such a manner that the first row of products 14 will encounter the ends of the fingers 26, and the products 14 drop into the bottom part 10 of the packages 9. After this packing step, the carrier members 21 continue to move past the second holder 25 between the fingers 26 (see FIG. 5). For obtaining correct packing of the products 14, the second holder 25 is movable stepwise in the direction of arrow B in order that the middle and last rows of products 14 should drop into the lower part 10 of the packages 9 in a correct manner. In the illustrated embodiment, use is made of two holders 20 with carrier members 21, but the number of holders 20 may be varied as desired. Thus, the carrier members 21 will follow a closed path and can be driven either continuously or stepwise according to a predetermined program in agreement with the sealing operation.

Figure 3:
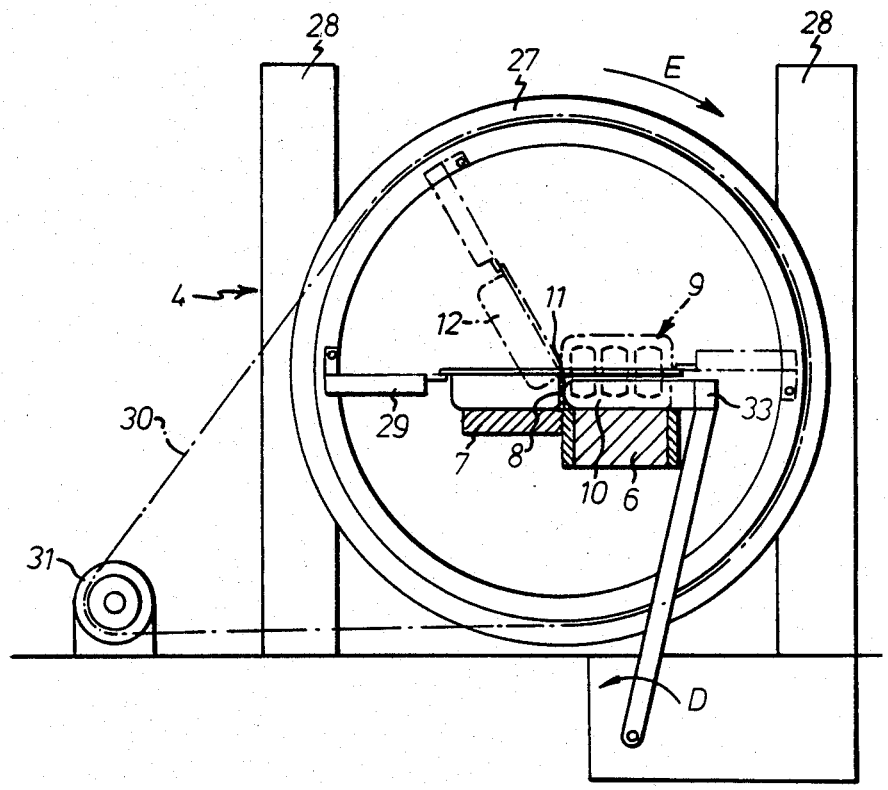
FIG. 3 shows the sealing station of the apparatus from in front with certain parts in section.

FIG. 3 shows the sealing station 4 with the rotatable ring 27 and the sealing plate 29 mounted thereon. When the filled packages 9 have been stopped by the stops 32 (see FIG. 1) in the sealing station 4, the second centering arm 33 is pivoted in the direction of arrow D in over the conveyor 6,.such that the packages 9 are momentarily held. The sealing plate 29 then is in its starting position and its above-mentioned edge portion engages with the end portion of the cover 12, as shown in full lines. The ring 27 is thereafter caused to rotate in the direction of arrow E in that the belt 30 is driven by the second motor 31. The sealing plate 29 is thus moved in the direction of arrow E so as to fold the cover 12 onto the lower part 10, as appears from the two positions indicated by dash-dot lines. In the extreme end position, the package 9 is sealed by means of a snap-action or stud lock. After sealing, the ring 27 is rotated in a direction contrary to that of arrow E, so that the sealing plate 29 again occupies its starting position. It should be noted that the line of articulation of the package 9 is located during the entire sealing operation at the centre of the ring 27.

Figure 4:
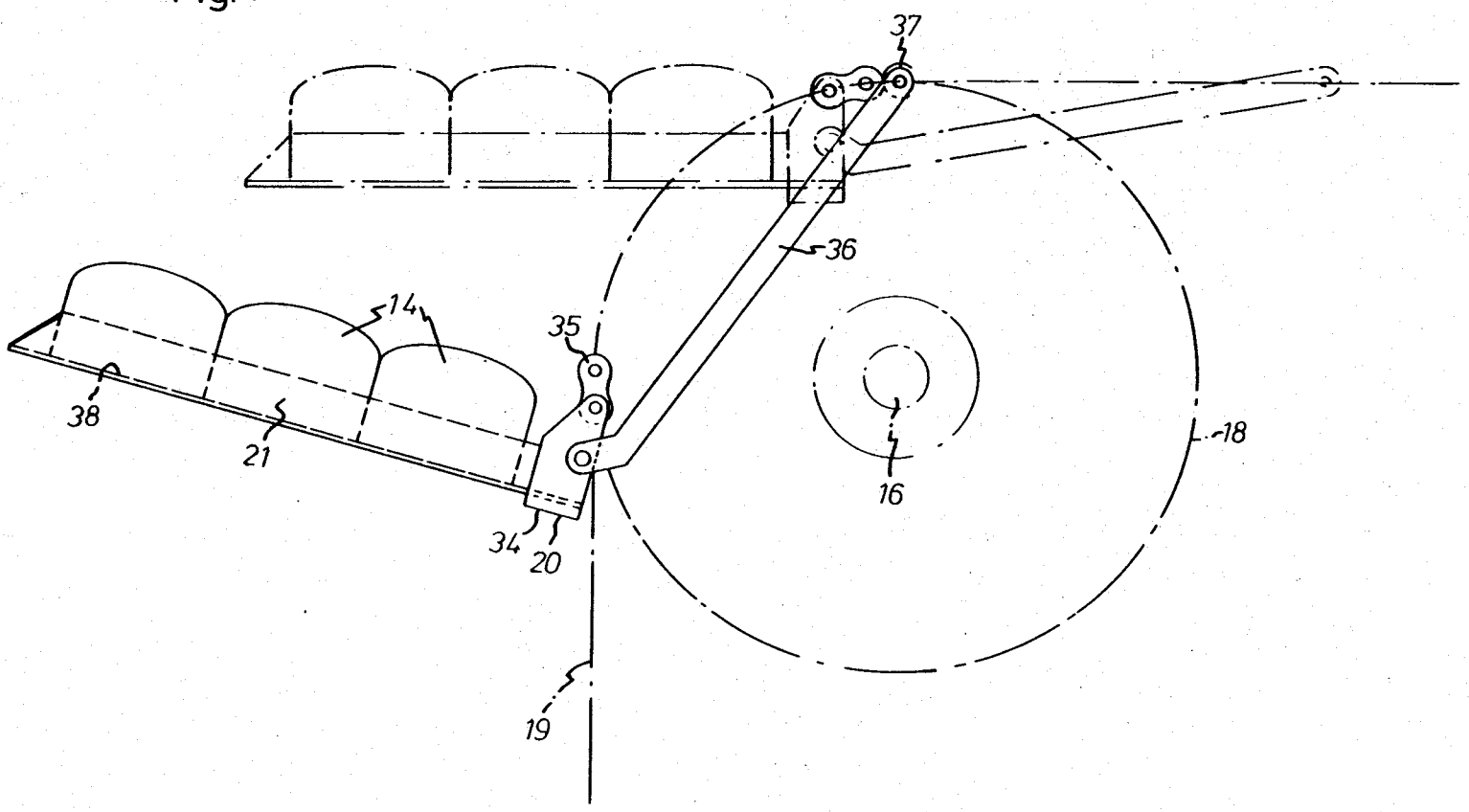
FIG. 4 shows in detail part of the packing station in FIG. 2, illustrating how a carrier member is collecting products.

In FIG. 4, it is shown in detail how the carrier members 21 are deflected at the sprockets 18. The holder 20 has at one end a link element 34 fixed to a first link 35 of the chain 19. An elongate link arm 36 is pivotally connected at one end to the link element 34 and at its other end pivotally connected to a second link 37 of the chain 19. The chain system 34, 35, 36, 37 is so designed that the carrier members 21, on which the products 14 rest with their planar bottom surfaces 38, are moved in a smooth path over the sprocket 18. The link system is so devised as to prevent the carrier members 21 from rocking when being guided over the sprocket 18. Since the bottom surface 38 of the products 14 is resting on the carrier members 21, the products 14 will be held steadily during the conveyance prior to packing.

The collecting position of the carrier members 21 is shown in full lines. In this position, the carrier members 21 are slightly inclined to ensure reliable retention of the products 14 at the beginning of the transport. The carrier members 21 are also shown in an upper, horizontal position representing the starting position of the movement of the carrier members 21 over the conveyor 6, as described above.

Figure 5:
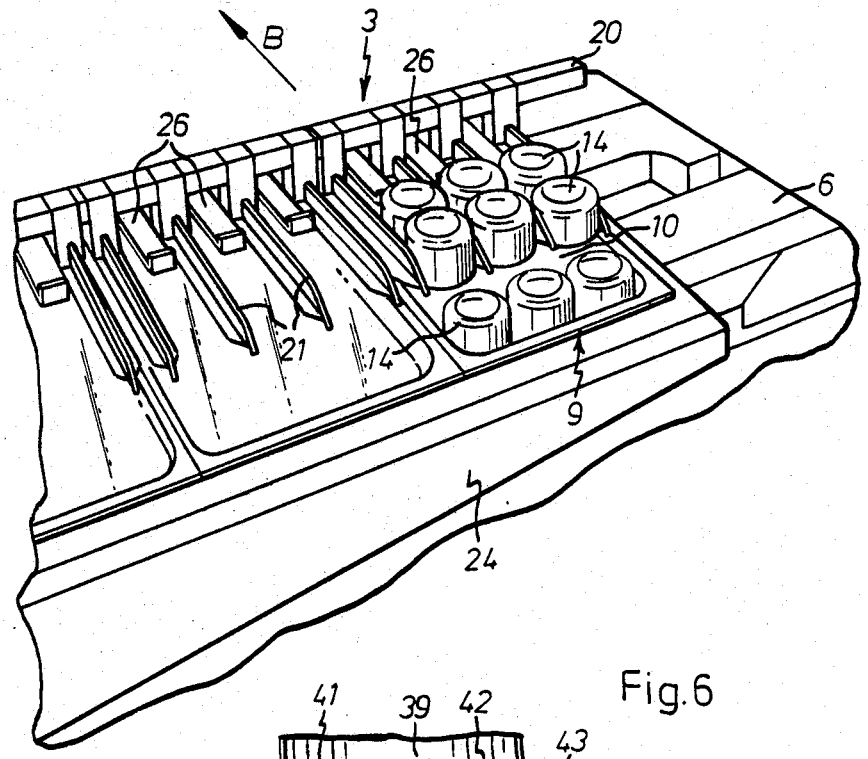
FIG. 5 shows the packing station in perspective, illustrating how the products are placed in a package.

The packing station 3 is shown in detail in FIG. 5. When the holder 20 and the carrier members 21 mounted thereon are moved in the direction of arrow B, the foremost row of products 14 encounters the fingers 26, whereby the products 14 will successively drop into the bottom part 10 of the package 9. In the position shown in FIG. 5, the rearmost row of products 14 has just dropped into the bottom part 10, and when the holder 20 continues to move in the direction of arrow B the central and foremost rows of products 14 will drop into the bottom part 10. It should be noted that the fingers 26 are stepwise displaceable through predetermined distances in the direction of arrow B to facilitate packing. It also clearly appears from FIG. 5 how the first centering arm 24 maintains the packages 9 during packing.

Figure 6:
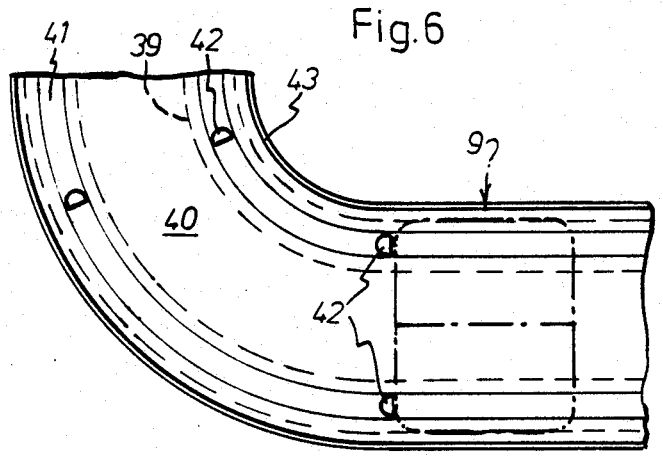
FIG. 6 is fragmentary view showing an alternative embodiment of the apparatus in FIG. 1, provided with another conveyor.

FIG. 6 shows an alternative embodiment of the apparatus according to the invention. The previously described conveyor 6 has been replaced by two endless parallel chains 39 provided underneath a table 40 on which the packages 9 can slide. The table 40 has two slots 41 in which drivers 42 mounted on the chains 39 move. The drivers 42 thus project above the plane of the table 40 and engage the packages 9 to be conveyed through the apparatus. For additional guidance of the packages 9, upright side rails 43 are provided on both sides of the table 40. In the use of an apparatus according to this embodiment, the previously described centering arms 24 and 33, holding the packages 9 in connection with the packing and sealing operations, may be dispensed with. Instead, the packages 9 are oriented momentarily in suitable positions with respect to packing and sealing, simply by stopping the chains 39.

The packing operation thus is carried out in the following way. Empty packages 9 are placed on the conveyor 6 in the delivery station 1. The packages 9 are thereafter conveyed to the packing station 3 in which the first centering arm 24 is swung in and maintains the packages 9 in position. At the collecting station 2, three rows of products 14 have been moved onto the carrier members 21, and these rows are transferred as a unit to the packages 9 by means of the carrier members 21. The foremost row of products 14 encounters the fingers 26, whereupon the products 14 drop into the bottom part 10 of the package 9, and the carrier members 21 continue their movement. The centering arm 24 is then swung away from the conveyor 6, and the filled packages 9 are conveyed to the sealing station 4 in which it is stopped by means of the stops 32. The centering arm 33 is thereafter swung in to maintain the packages 9. The sealing plate 29 folds the cover 12 of the package 9 onto the bottom part 10 and the sealing operation is completed. Finally, the sealing plate 29 is returned to its initial position, and the sealed packages 9 are conveyed to the discharge station 5 for further handling. It is of course possible to use other sealing methods. For example, the bottom part 10 and the cover 12 may be joined together by hot pressing.

It will be understood that the apparatus according to the invention can be modified in different ways without departing from the inventive concept. In the foregoing, the apparatus has included only one conveyor 6, but it is of course possible to use several conveyors. The packing station 3 may have a conveyor of its own cooperating with a conveyor pertaining to the sealing station 4. The sealing station 4 may thus, if desired, be dispensed with or exchanged for another sealing station or vice versa.

Further, the apparatus can be used for packing products of many different types, which however preferably have at least one planar surface for resting on the carrier members. Moreover, several different packages, with or without folding covers, may be used, which packages can accommodate a varying number of products and can be moved through the apparatus one by one, two by two etc. In that case, the apparatus is preferably provided with other stop means and/or centering means.

I claim:

1. An apparatus for automatically packing fragile products in a package, said apparatus comprising:

(a) a delivery station for delivering empty packages, (b) a collecting station for products, (c) a packing station located opposite said collecting station and arranged for packing products in a package, and (d) a conveyor for conveying a package through said deliver station and said packing station said packing station having (i) carrier members movable substantially transversely of said conveyor for collecting products from said collecting station opposite said packing station, said members having carrying surfaces for carrying products thereon, and (ii) means provided in the path of movement of said carrier members across said conveyor for gently removing products from said carrier members and causing removed products to drop into a package on said conveyor.

2. Apparatus as claimed in claim 1, wherein said means in said path of movement comprise a holder from which fixedly mounted fingers project in a direction contrary to the direction of movement of said carrier members.

3. Apparatus as claimed in claim 1, in which products located in said collecting station are arranged in one or more rows which are substantially parallel to a portion of said conveyor extending through said packing station and a predetermined number of said rows are simultaneously movable across said conveyor by means of said carrier members to permit successive packing of products row by row in a package (9).

4. Apparatus as claimed in claim 2, wherein said holder carrying said fingers is stepwise displaceable through predetermined portions of said path of movement, in synchronism with the movement of said carrier members, to ensure that products will successively drop into packages.

5. Apparatus as claimed in claim 1, wherein said packing station comprises four shafts mounted in pairs in a frame and disposed on both sides of and substantially parallel to said conveyor and having at both ends fixedly mounted guide pulleys over which ends endless drive means run, at least one of said shafts being driven by means of a first drive unit; at least one holder on which said carrier members are mounted and which is fixed at its ends to said drive means in such a manner that said carrier members, when said guide pulleys are driven, can be moved in a closed path to said collecting station and across said conveyor, that said holder during its entire movement is substantially parallel to said shafts, and that said carrier members during their movement are supporting products substantially horizontally.

6. Apparatus as claimed in claim 5, wherein said guide pulleys with associated drive means consist of sprockets and chains or belt pulleys and belts, respectively.

7. Apparatus as claimed in claim 1, wherein said packing station has a centering arm movable over said conveyor for momentarily fixing an empty package in a position opposite said collecting station.

8. Apparatus as claimed in claim 1, wherein said conveyor comprises at least one endless drive means including a chain and drivers for moving packages through said apparatus and for orienting packages in connection with a packing operation.

9. Apparatus as claimed in claim 1, further comprising a sealing station through which said conveyor runs and located downstream of said packing station, said sealing station including a sealing means for engaging a cover of a filled package and moving over the package to seal the cover to a bottom portion of the package.

10. An apparatus for automatically packing fragile products in a package, said apparatus comprising:

(a) a delivery station for delivering empty packages;

(b) a collection station for products;

(c) a packing station located opposite said collecting station and arranged for packing products in a package;

(d) a conveyor for conveying packages through said delivery station and said packing station, said packing station having (i) carrier members movable substantially transversely of said conveyor for collecting products from said collecting station opposite said packing station, said members having carrying surfaces for carrying products thereon, and (ii) means provided in the path of movement of said carrier members across said conveyor for gently removing products from said carrier members and causing the moved products to drop into a package on said conveyor; and (e) a sealing station located downstream of said packing station on said conveyor, said sealing station including (i) a sealing means for engaging a cover of a filled package and moving over the package to seal the cover to a bottom portion of the package, (ii) a frame, (iii) a ring rotatably mounted in said frame and surrounding said conveyor such that during a sealing operation, a line of articulation of a package is located at the center of said ring, and (iv) means for rotating said ring including an endless drive means, and a second drive unit for driving said endless drive means, said sealing means further comprising a plate projecting substantially in parallel with said conveyor and having an end fixed to said ring, said means for rotating said ring alternatingly rotating said ring whereby said plate is moved by said ring in a substantially circular sector-shaped path.

11. A sealing station for an apparatus for gently packing fragile products in packages, said sealing station comprising:

a frame;

a ring rotatably supported in said frame for receiving a package therein with a line of articulation of a received package located substantially at the center of said ring;

means for rotating said ring, said means for rotating including endless driven means and drive means for driving said endless driven means; and sealing means for engaging a cover of a received package and folding over the package about its line of articulation to seal the cover to a bottom portion of a received package, said sealing means including a plate having an end fixed to said ring, said means for rotating said ring alternatingly rotating said ring to move said plate in a substantially circular sector-shaped path.

* * * * *